313-414
SR
OR 4,362,964

United States Patent [19]
Sakurai et al.
[11] 4,362,964
[45] Dec. 7, 1982

[54] COLOR PICTURE TUBE WITH A MAGNETIC FOCUSING DEVICE

[75] Inventors: Soichi Sakurai; Kyohei Fukuda, both of Mobara; Masanobu Takata, Chiba, all of Japan

[73] Assignee: Hitachi, Ltd., Tokyo, Japan

[21] Appl. No.: 89,095

[22] Filed: Oct. 29, 1979

[30] Foreign Application Priority Data

Oct. 30, 1978 [JP] Japan ..... 53/132669

[51] Int. Cl.³ ..... H01J 29/52; H01J 29/56; H01J 29/50

[52] U.S. Cl. ..... 313/414; 313/412

[58] Field of Search ..... 313/414, 412, 413, 411

[56] References Cited

U.S. PATENT DOCUMENTS 4,057,747 11/1977 Hamano ..... 313/413
4,196,370 4/1980 Hughes ..... 313/413

FOREIGN PATENT DOCUMENTS 734764 4/1943 Fed. Rep. of Germany ..... 313/414
2826858 1/1979 Fed. Rep. of Germany ..... 313/414
50-26274 8/1975 Japan ..... 313/412
52-45259 4/1977 Japan ..... 313/414

*Primary Examiner*—Robert Segal
*Attorney, Agent, or Firm*—Antonelli, Terry and Wands

[57] ABSTRACT

There is disclosed an in-line type three-gun color picture tube with a couple of magnetic members inside its neck portion and a further magnet outside its neck portion. The respective magnetic members are provided with three through-holes permitting electron beams emitted from the electron guns to pass through and are disposed separately in a beam traveling path, so that the periphery of the through-holes of one of the magnetic members is magnetized in S pole and that of the other magnetic member is magnetized in N pole, and accordingly a focusing magnetic field is formed between the respective pairs of the through-holes which are opposite to each other. The magnetic pieces are disposed between the adjacent through-holes to intensify the magnetic field in the alignment of the through-holes which is weakened due to the presence of the through-holes, so that the focusing magnetic field in the alignment of the through-holes is compensated and accordingly the respective focusing magnetic fields become symmetrical with respect to their axes.

17 Claims, 6 Drawing Figures

COLOR PICTURE TUBE WITH A MAGNETIC FOCUSING DEVICE

BACKGROUND OF THE INVENTION

1. Field of the Invention

This invention relates to a color picture tube with a magnetic focusing device which provides an improved circularity of an electron beam spot.

2. Cross-Reference to Related Application

In a focusing device for focusing electron beams in a color picture tube with electron guns for red, blue and green arranged in a row, which is disclosed in U.S. application Ser. No. 917,179 filed by one of the present applicants on June 20, 1978 and assigned to the same assignee, a color picture tube is provided at the neck portion with a couple of magnetic members having through-holes permitting the electron beams to pass therethrough and disposed separately in the tube axial direction, and a magnetizing means for magnetizing the respective magnetic members, thereby to form focusing magnetic lenses in spaces between pairs of through-holes in which the paired holes are opposite to each other.

The magnetic focusing device will further be described with reference to FIG. 1 and FIGS. 2*a* and 2*b*. FIG. 1 shows a longitudinal sectional view of an inline type three-gun color picture tube with the magnetic focusing device, FIG. 2*a* shows an enlarged sectional view of a neck portion of the tube shown in FIG. 1, and FIG. 2*b* shows an enlarged cross sectional view taken along line IIa—IIb of FIG. 1. In the figures, reference numerals 1, 2 and 3 designate electron guns for red, green and blue for emitting red, green and blue electron beams 91 to 93, respectively; 4 a glass tube portion of a cathode ray tube; 5 a tubular permanent magnet disposed around the glass tube portion 4; 6 and 7 magnetic members of high permeability with through-holes 61 to 63 and 71 to 73 through which the electron beams 91, 92 and 93 pass; 8 a fluorescent screen. A magnetic flux emanating from the N pole of the tubular permanent magnet 5 enters the tubular part 74 of the magnetic member 7, emanates from the holes 71, 72 and 73 toward the holes 61, 62 and 63 of the magnetic member 6, enters again the magnetic member 6, emanating from the tubular part 64 of the magnetic member 6, and returns to the S pole of the tubular permanent magnet 5. Therefore, the periphery of each of holes 71 to 73 is magnetized in an S pole while the periphery of each of holes 61 to 63 is magnetized in an N pole. As a result, focusing magnetic fields are formed between the respective pairs of the holes 61 and 71, 62 and 72, and 63 and 73, respectively.

With this magnetic focusing device, the magnetic field component in the direction (X direction) in which the electron guns are arranged, is weaker than that in the direction (Y direction) orthogonal to the X direction. Therefore, the focusing magnetic lenses formed are not symmetrical with respect to the tube axis. In the case of the focusing magnetic lens for the central electron beam 92, the magnetic flux in the X direction which passes through the magnetic member 7 to reach the hole 72 is partly emitted from the adjacent holes 71 and 73, with the result that the magnetic field in the X direction is weaker than that in the Y direction, by about 10% which is confirmed by our experiment. Accordingly, the focusings of the electron beams 91, 92 and 93 in the X direction are different from those in the Y direction, so that the beam spots of those beams are each not circular and are flatly deformed in the Y direction to have an elliptical shape in the X direction. When the electron beam passes through the focusing magnetic field, there is generated a rotational force rotating about its center of the beam traveling path. By the rotational force generated, the beam spot flatly deformed rotates and then impinges upon the fluorescent screen.

When the spot is flatly deformed, the resolution in the widened direction of the beam spot is considerably deteriorated and further the adjacent focusings are adversely affected to a great extent.

SUMMARY OF THE INVENTION

Accordingly, an object of the invention is to provide a color picture tube with a magnetic focusing device which minimizes the deterioration of the resolution due to the flat deformation of the beam spot.

To achieve the above object, a magnetic flux concentration means are provided near the through-holes of the magnetic members. The through-holes are aligned in a given direction. The magnetic field in the direction of the hole alignment, which is weakened due to the presence of the holes, is intensified by the magnetic flux concentration means, so that the weakened magnetic field is compensated and focusing magnetic fields symmetrical with the axes thereof are obtained.

DESCRIPTION OF THE PREFERRED EMBODIMENTS

Figure 1:
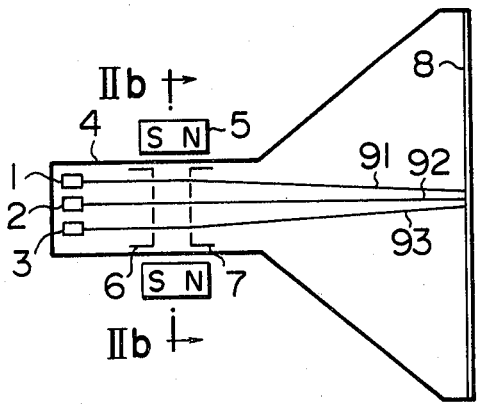
FIG. 1 shows a longitudinal sectional view of an in-line type three-gun color picture tube with a magnetic focusing device.
Figure 4:
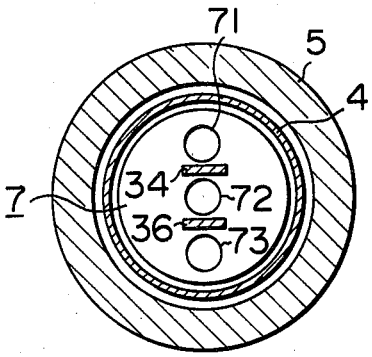
FIG. 4 shows an enlarged cross sectional view of a neck portion of a color picture tube with a magnetic focusing device which is another embodiment according to the invention.
Figure 2A:
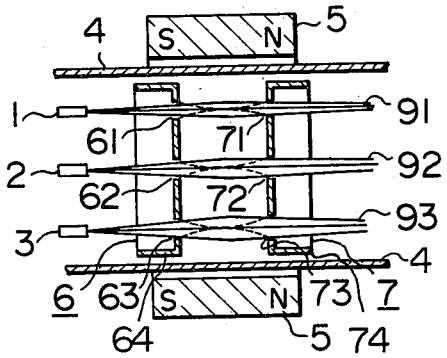
FIG. 2*a* shows an enlarged sectional view of a neck portion of the color picture tube shown in FIG. 1.
Figure 2B:
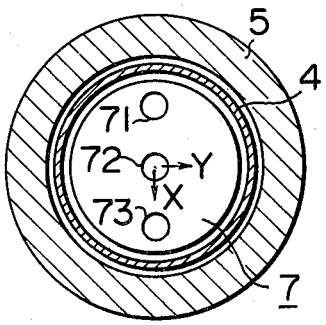
FIG. 2*b* shows an enlarged cross sectional view taken along line IIb—IIb of FIG. 1.
Figure 3A:
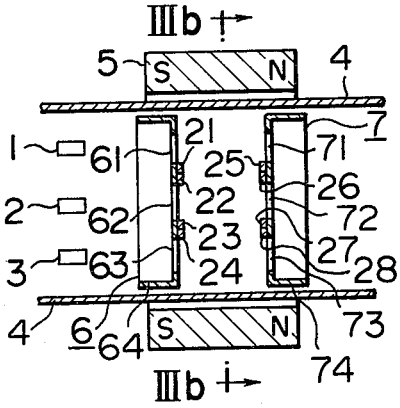
FIG. 3*a* shows an enlarged sectional view of a neck portion of a color picture tube with a magnetic focusing device which is an embodiment according to the invention.
Figure 3B:
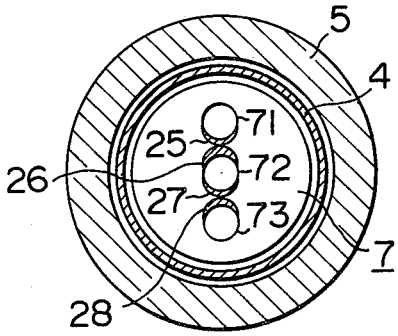
FIG. 3*b* shows an enlarged cross sectional view taken along line IIIb—IIIb of FIG. 3*a*.

In FIGS. 3*a* to 3*b*, reference numerals 21 to 24 designate magnetic pieces disposed on the peripheries of the through-holes and on and along an alignment of the holes 61 to 63; 25 to 28 magnetic pieces disposed on the peripheries of small holes 71 to 73 on and along an alignment of the holes 71 to 73. The magnetic pieces 21 to 24 and 25 to 28 are fixed to magnetic members 6 and 7, respectively, by an adhesive agent or the like. The magnetic pieces 21 to 24 and 25 to 28 disposed on the alignments of the through-holes 61 to 63 and 71 to 73, concentrate the magnetic flux in the alignment direction, so that the magnetic field in the alignment direction is intensified as compared with the case where the magnetic pieces 21 to 24 and 25 to 28 are not provided. When those magnetic pieces 21 to 24 and 25 to 28 are not used, the X directional components of focusing magnetic fields formed between the respective pairs of the through-holes 61 and 71, 62 and 72, and 63 and 73 are weaker than the Y directional components thereof. For this, these focusing magnetic fields are not symmetrical with respect to their axes. On the other hand, when the magnetic pieces 21 to 28 are used as in this embodiment, the X directional components of the magnetic field, which is weakened when those pieces are not used, is intensified and the weakened magnetic field is compensated. As a result, the focusing magnetic fields formed between the respective pairs of the through-holes 61 and 71, 62 and 72, and 63 and 73 are symmetrical with respect to the axes thereof to prevent the electron beams passing therethrough from being flatly deformed in the cross section. The magnetic pieces added may be disposed not only between the through-holes but also on the upper side, in the X direction, of the through-holes 61 and 71 or on the lower side, in the direction of the through-holes 63 and 73. As shown in FIG. 4, further, rectangular magnetic pieces 34 and 36 may be placed between the through-holes 71 and 72, and 72 and 73. In that case, the magnetic piece 34 serves as those pieces 27 and 28 in FIGS. *3a* and *3b*. Moreover, in place of using the magnetic pieces 21 to 28, 34 and 36, the upper and lower edges (Y direction) of each of the through-holes 71, 72 and 73 are cut away to be thinner in the thickness so that the focusing magnetic field in the Y direction is not more intensified than that in the X direction.

We claim:

1. A color picture tube comprising a plurality of electron guns horizontally disposed in-line in a neck portion of said tube, a pair of magnetic plate members of high permeability with adjacent through-holes disposed in-line in a horizontal direction of the tube for permitting electron beams emitted from the electron guns to pass therethrough, respectively, said pair of magnetic members being disposed apart from and opposite each other in an axial direction of said tube in the neck portion of said tube, magnetizing means for magnetizing one of said pair of magnetic members in one polarity and the other of said pair of magnetic members in the other polarity to produce a plurality of magnetic focusing lenses, each of said magnetic focusing lenses being present between mutually opposed through-holes of said pair of magnetic plate members and having a lens axis coinciding with a pair of the electron beam passing therethrough, each of said through-holes of respective magnetic focusing lenses having a symmetrical shape with respect to the lens axis so that each of said magnetic focusing lenses has a non-symmetrical magnetic field distribution with respect to the lens axis due to the in-line alignment of said through-holes, and modifying means disposed on said magnetic plate members for modifying the magnetic reluctance of each said magnetic plate member to be smaller at portions of said magnetic plate member between said adjacent through-holes than at other portions of said magnetic plate member so as to provide a greater concentration of the magnetic flux in the hole alignment direction of said tube than the concentration of magnetic flux in a direction orthogonal to the hole alignment direction of the tube, thereby enabling each of said magnetic focusing lenses to have symmetric magnetic field distribution with respect to the lens axis thereof.

2. A color picture tube according to claim 1, wherein said modifying means comprises a plurality of pieces of magnetic material with high magnetic permeability, at least parts of respective ones of said pieces of magnetic material being disposed on a portion of each said magnetic plate member between said adjacent through-holes.

3. A color picture tube according to claim 2, wherein each magnetic plate member includes at least three through-holes extending in the hole alignment direction.

4. A color picture tube according to claim 6, wherein each of said through-holes has a circular shape and said magnetizing means includes a tubular magnet disposed around the neck portion of said tube.

5. A color picture tube according to claim 2, wherein said plurality of pieces of magnetic material are disposed on the facing surface portions of said opposing magnetic plate members.

6. A color picture tube according to claim 5, wherein each rectangular shaped piece of magnetic material has long and short sides, the long sides extending in the direction orthogonal to the hole alignment direction.

7. A color picture tube according to claim 2, wherein each of said pieces of magnetic material has a rectangular shape, respective ones of said pieces of magnetic material being disposed on each said magnetic plate member at a middle portion thereof between adjacent through-holes.

8. A color picture tube according to claim 4, wherein said modifying means is formed by different thicknesses of said magnetic plate members in the region of said through-holes thereof, said modifying means providing a smaller thickness of each said magnetic plate member at peripheries of each said through-hole orthogonal to the hole alignment direction than the thickness of each said magnetic plate member at a periphery of each said through-hole in the hole alignment direction.

9. A color picture tube comprising a plurality of electron guns horizontally disposed in-line in a neck portion of said tube, a pair of magnetic plate members of high permeability with adjacent through-holes disposed in-line in a horizontal direction of the tube for permitting electron beams emitted from the electron guns to pass therethrough, respectively, said pair of magnetic members being disposed apart from and opposite each other in an axial direction of said tube in the neck portion of said tube, magnetizing means for magnetizing one of said pair of magnetic members in one polarity and the other of said pair of magnetic members in the other polarity to produce a plurality of magnetic focusing lenses, each of said magnetic focusing lenses being present between mutually opposed through-holes of said pair of magnetic plate members and having a lens axis coinciding with a path of the electron beam passing therethrough, each of said through-holes of respective magnetic focusing lenses having a symmetrical shape with respect to the lens axis so that each of said magnetic focusing lenses has a non-symmetrical magnetic field distribution with respect to the lens axis due to the in-line alignment of said through-holes, and modifying means disposed on said magnetic plate members for modifying the magnetic reluctance of each said magnetic plate member to be smaller at portions of said magnetic plate member between said adjacent through-holes than at other portions of said magnetic plate member so as to provide a greater concentration of the magnetic flux in the hole alignment direction of said tube than the concentration of magnetic flux in a direction orthogonal to the hole alignment direction of the tube, thereby enabling each of said magnetic focusing lenses to have symmetric magnetic field distribution with respect to the lens axis thereof, said modifying means comprising a plurality of pieces of magnetic material with high magnetic permeability, at least parts of respective ones of said pieces of magnetic material being disposed on a portion of each said magnetic plate member between said adjacent through-holes, each magnetic plate member including at least three through-holes extending in the hole alignment direction, each of said pieces of magnetic material having a crescent shape, respective ones of said pieces of magnetic material being disposed at both side half peripheries in the hole alignment direction of a center through-hole and at least one side half periphery in the hole alignment direction of other through-holes positioned adjacent the center through-hole.

10. A color picture tube according to claim 9, wherein respective pieces of magnetic material are disposed at both side peripheries in the hole alignment direction of the other through-holes positioned adjacent the center through-hole.

11. In a color picture tube with a magnetic focusing device and having a plurality of electron guns arranged in a row in a horizontal direction in a neck portion of the tube, a pair of magnetic plate members each provided with plural through-holes of circular shape corresponding to the respective electron guns and permitting electron beams emitted from the corresponding electron guns to pass therethrough, the plate members being disposed apart from each other in an axial direction of the tube, and magnetizing means for magnetizing one of the magnetic plate members in one polarity and the other one of the magnetic plate members in the other polarity, the improvement comprising the magnetic plate members each being provided with magnetic flux concentration means for partially concentrating the magnetic flux to be greater at peripheral side portions of the through-holes of the magnetic plate member in a hole alignment direction than the concentration of the magnetic flux at peripheral portions of the through-holes of the magnetic plate member in a direction orthogonal to the hole alignment direction so as to form magnetic focusing lenses between mutually corresponding through-holes of the pair of magnetic plate members having a symmetrical magnetic field distribution with respect to the axis of each of the magnetic focusing lenses.

12. A color picture tube according to claim 11, wherein the magnetic flux concentration means comprises a plurality of pieces of magnetic material having high magnetic permeability, at least parts of respective ones of the pieces of magnetic material being disposed on a portion of each magnetic plate member at least between the through-holes.

13. A color picture tube according to claim 12, wherein the pieces of magnetic material are disposed on the facing surface portions of the magnetic plate members.

14. A color picture tube according to claim 13, wherein the magnetic material pieces have a crescent shape and are disposed at the side half peripheries of the through-holes in the hole alignment direction between adjacent through-holes.

15. A color picture tube according to claim 13, wherein the magnetic material pieces have a rectangular shape and are disposed between adjacent through-holes in the hole alignment direction.

16. A color picture tube according to claim 15, wherein the rectangular shaped pieces of magnetic material have long and short sides, the long sides extending in the direction orthogonal to the hole alignment direction.

17. A color picture tube according to claim 11, wherein the magnetic flux concentration means is formed by different thicknesses of the magnetic plate member in the region of the through-holes thereof, the flux concentration means providing a smaller thickness of the magnetic plate member at peripheries of the through-holes in a direction orthogonal to the hole alignment direction than the thickness of the magnetic plate member at the periphery of each through-hole in the hole alignment direction.

* * * * *